United States Patent [19]

Costa, Jr.

[11] 4,130,689

[45] Dec. 19, 1978

[54] PRODUCTION OF HIGH STRENGTH HOLLOW RAYON FIBERS

[75] Inventor: Eugene Costa, Jr., Goshen, N.Y.

[73] Assignee: International Paper Company, New York, N.Y.

[21] Appl. No.: 798,874

[22] Filed: May 20, 1977

Related U.S. Application Data

[63] Continuation-in-part of Ser. No. 694,918, Jun. 11, 1976, abandoned.

[51] Int. Cl.[2] ..... D01F 2/08

[52] U.S. Cl. ..... 428/398; 264/51; 264/54; 264/193; 264/195; 264/197; 264/209

[58] Field of Search ..... 428/398; 264/209, 195, 264/197, 188, 51, 54, 193, 194

[56] References Cited

U.S. PATENT DOCUMENTS

| | | | |
|---|---|---|---|
| 3,626,045 | 12/1971 | Wooding | 264/54 |

FOREIGN PATENT DOCUMENTS

| | | | |
|---|---|---|---|
| 1143666 | 10/1957 | France | 264/188 |
| 40-9536 | 5/1965 | Japan | 264/188 |
| 48-20164 | 6/1973 | Japan | 264/188 |
| 45-34402 | 11/1978 | Japan | 264/188 |
| 1393778 | 5/1975 | United Kingdom | 264/188 |

*Primary Examiner*—Jay H. Woo

[57] ABSTRACT

High strength hollow rayon fibers or filaments which will recover their hollow configuration after being immersed in water and subsequently dried are provided by an in-line process whereby a viscose solution containing a blowing agent is extruded into an aqueous acid coagulating bath of relatively high acid concentration. The conditions of the process result in hollow filaments that are substantially irreversible since they remain hollow and do not collapse even after repeated washing and drying cycles. The hollow filaments also possess high strength nearly equivalent to that of high wet modulus rayon fibers. Modifiers may be employed in achieving this effect, but are not necessary.

25 Claims, No Drawings

PRODUCTION OF HIGH STRENGTH HOLLOW RAYON FIBERS

This application is a continuation-in-part of my copending application, Ser. No. 694,918, filed June 11, 1976, now abandoned.

BACKGROUND OF THE INVENTION

The present invention relates to processes for the production of high strength hollow rayon fibers or filaments which will recover their hollow condition after being immersed in water and in a preferable embodiment are substantially irreversible in that they remain hollow and do not collapse even after repeated drying and washing cycles. The invention relates also to the hollow rayon fibers produced.

Hollow rayon fibers are known to the prior art. They have a number of known uses in the production of paper and non-woven products. They have been produced by incorporating a blowing agent, such as sodium carbonate or sodium bicarbonate, into the viscose solution after the xanthation stage in the viscose rayon process. In the prior art processes, the viscose, containing the blowing agent, is spun into the conventional acidic spin bath whereby carbon dioxide gas is liberated from the blowing agent causing the fibers to blow or expand to several times their natural diameter. A number of patents disclose processes of this type and they have in common the shortcoming that when the fibers or filaments are dried, the fiber walls collapse and, in most instances, hydrogen bond together to form a flat, ribbon-like fiber. It has been the desire of the rayon industry for some time to provide hollow rayon fibers which would not collapse upon drying and which will retain their hollow configuration for a very substantial number of washing and drying cycles.

Woodings U.S. Pat. No. 3,626,045 is a patent disclosing a method of blowing rayon fibers. It seeks to overcome the problem of fiber wall collapse upon drying by adding to the viscose prior to spinning of from 0.75 to 2.0% by weight of polyethylene glycol based on the weight of the cellulose. The hollow rayon fibers which result can be dried after being formed without collapsing. However, the product of the patent has other shortcomings.

In accordance with the present invention, the disadvantages of conventional prior art blown hollow rayon fibers have been overcome by unique conditions of the processes of the present invention. These parameters are defined in the examples.

Patents disclose various methods for making hollow fibers, but none of which applicant is aware teaches or suggests a means which provides a high strength hollow rayon fiber which is substantially irreversible in the sense that it will not collapse upon being dried. These patents include: British Pat. No. 945,306; British Pat. No. 1,393,778; and Freund U.S. Pat. No. 2,013,491.

British Pat. No. 488,500 discloses a process for producing hollow cellulose acetate fibers by extruding a solution of the acetate downward into a volatile solvent medium and in a complicated manner produces a hollow fiber.

Kajitani U.S. Pat. No. 3,418,405 discloses a process for producing flat viscose fibers by extruding blown viscose into a medium containing a modifier, and such modifier is polyethylene glycol. The whole purpose is to produce a hollow fiber which will very readily collapse and form a flat fiber. This is just the opposite of the purpose of the present invention.

French Pat. No. 1,143,666 discloses the use of adducts of ethylene glycol and phenol, including the adduct of 15 units of ethylene oxide per molecule of phenol, as a viscose modifier. The purpose of this is strictly to produce a high strength solid rayon fiber suitable for a tire yarn end use. Howsman U.S. Pat. Nos. 2,890,130 and 2,890,132 disclose similar adducts of ethylene oxide with cresol and lactams, respectively, for the same purpose. None of these patents is concerned with the preparation of hollow rayon fibers.

British Pat. No. 1,393,778 discloses the preparation of multi-lobal collapsed fibers, which is not what the present invention is concerned with, by a process which is quite different from that of the present invention.

Patents disclose the treatment of cellulosic products in one form or another with aldehydes, but none of which applicant is aware teaches or suggests a means which provides a hollow rayon fiber which is substantially irreversible in the sense that it will not collapse upon being dried. These patents are: Alles U.S. Pat. No. 2,123,493; Drisch U.S. Pat. No. 2,597,624; Spining U.S. Pat. No. 2,935,373; Elssner U.S. Pat. No. 3,007,766; Reeves et al. U.S. Pat. No. 3,046,079; Drisch U.S. Pat. No. 3,351,696; and Canadian Pat. No. 898,461.

Cotton et al. U.S. Pat. No. 3,622,261 discloses a process for fixing formaldehyde on cellulose with the aid of a carbamate so that a fabric made of the cellulose will retain its wash and wear characteristics. But nothing in the patent relates to hollow rayon fibers and their production.

In a paper entitled "Never-Dried Cotton Fibers" by J. L. Williams et al., Textile Research Journal, Vol. 44, No. 5, pp. 370–377 (May 1974), and in the authors' corresponding U.S. Pat. No. 3,907,499, the authors describe a treatment of cotton, which has never been dried, with a dilute solution of formaldehyde. The authors state that this treatment prevents the cotton fiber walls from hydrogen bonding and that a cotton fiber is obtained, which when submerged in water, after having been dried, would to an extent reswell to an open configuration. The treatment of the process does not prevent collapse of the cotton fibers upon drying. It merely permits reswelling when the dried cotton fibers are again wetted with water. The authors are in no way concerned with hollow rayon fibers or methods for their production.

The hollow fibers of rayon produced by the processes of the invention do not collapse even when dried and in a preferred embodiment will not collapse even when subjected to a sequence of drying and washing treatments. The processes also produce a uniformly large number of blown fibers such as more than 90 or 95%.

The fibers produced from the preferred embodiment of the processes not only have permanent hollowness, but also exhibit high strength and sufficient crimp to permit ease in carding. The fibers produced by the processes of the present invention have properties similar to commercial high wet modulus rayon and are approaching that of cotton. Fabrics made from the hollow rayon fibers in the preferred embodiment produced by the present invention exhibit excellent bulk coverage, a dye absorption equivalent to that of cotton, and an opacity that is duller than either rayon or bleached cotton. Thus, this fiber would require less dulling agents during production than regular rayon.

It is, accordingly, an objective of the present invention to provide an in-line process for producing hollow rayon fibers of high strength that have the property of resisting collapse even after drying and washing treatments and which have large continuous lumens.

It is also an object of the present invention to provide hollow rayon fibers that have high bulk or covering power such as are useful in producing non-wovens or garments employed for outer wear or as dialysis tubes.

It is a further object of the present invention to provide hollow rayon fibers that have a soft, comfortable hand and which will retain their hollow condition after being immersed in water and then dried.

It is another object of the present invention to provide hollow rayon fibers which have high moisture absorption, thermal insulation and dielectric properties.

It is another object of this invention to produce fibers of high strength having greater than 3 g/d tenacity when tested in a conditioned atmosphere and greater than 1.8 g/d when tested in a wet state.

Other objects will be apparent to those skilled in the art from the present description.

GENERAL DESCRIPTION OF THE INVENTION

The present invention is directed to novel hollow rayon fibers which retain their hollow condition and can be substantially irreversible in that they resist collapse, even upon repeated dryings and washings, and to a novel in-line process for producing them. The resultant hollow rayon fibers are characterized by having a soft, comfortable hand, high moisture absorption properties and large continuous lumens. These hollow rayon fibers have high bulk, strength, moisture absorption, thermal insulation and dielectric properties and covering power and are useful in producing paper products, non-wovens, garments specifically intended for outer wear, and in tubular dialysis cells. The products are characterized by their substantially irreversible nature in that they remain hollow after repeated dryings and washings.

Basically, the process of the present invention results from the discovery that after the fibers or filaments are blown, and before they are dried, their outer walls can be hardened or toughened so that they acquire an outer wall strength that resists collapse of the fiber walls even when repeatedly washed and dried. This toughening can be achieved by one of several means embodied by the present invention. In accordance with one such means, the outer wall hardening can be achieved by employing an aqueous spin bath containing a high zinc sulfate concentration at an optimum, acid and sodium sulfate concentration, into which the viscose containing a high percentage of $CS_2$ is spun and in which the fibers are blown by action of the acid on the carbonate blowing agent in the viscose. The conditions of the viscose, ripening index viscosity, NaOH concentration, etc. and that of the spin bath composition are such that regeneation and coagulation is delayed until the blown viscose reaches the stretch zone. This then permits the blown xanthate to undergo a high degree of orientation as crystallization is taking place, thereby creating a blown hollow filament possessing a highly oriented crystalline outer wall structure. This structure has been known to have a high resistance to deformation and thereby cause the fibers to maintain this hollow configuration even after repeated washing and drying cycles.

Wall hardening can also be achieved by employing a modifying agent in the viscose that retards the regeneration, and/or coagulation of the viscose such as a polyoxyethylene adduct of phenol having from about 5 to 25 moles of ethylene oxide per mole of phenol. The spin acid composition could be balanced against the properties of the viscose containing the modifier so as to permit crystallization to occur during the stretching operation. Also, wall hardening can be enhanced by subjecting the blown hollow rayon filaments or fibers to a subsequent aqueous formaldehyde treatment. The mechanism of creating the durable fiber is completely different in this case than in the previous illustrations, although the overall effect is similar. The formaldehyde mildly cross-links the walls of the fiber. This action provides two purposes. It stiffens the walls to a certain extent thereby creating a hardened shell. It also ties up the OH groups on the cellulose molecule, thereby preventing hydrogen bonding from occurring during drying. The later property is used in a more economical process where the fiber is not highly oriented. Though the fibers from this process are more economically produced, their strength is somewhat impaired and the durability of the fibers' hollowness is lowered. It can only withstand a few wash and dry cycles before the fiber walls collapse.

However, the processes of the invention do not require a modifier in the viscose or the formaldehyde treatment following the stretch bath, if it is carried out with the correct balance of viscose and spin composition as cited in the first case. This is one of the advantages of the present invention.

The concept of the present invention is based on creating a hardened wall so as to prevent fiber wall collapse. It is not limited to the methods illustrated in the examples which folow. Any combination of the three cases described above or any other method of forming ether linkages or any cross-linking processes or other methods of tying up the OH groups on the celulose comprising the outer portion of the fiber or the fiber wall to prevent hydrogen bonding or any other method of hardening the fiber wall to prevent collapse such as grafting of other polymers, or by various irradiation techniques are all included in this concept.

The processes of the present invention comprise first the spinning of a viscose solution containing cellulose in an amount of from about 6% to 9.5% (preferably 6.5 to 7.5%) on the weight of viscose, alkali-metal hydroxide, such as sodium hydroxide in the amount of from about 6% to 8% (preferably about 6.5 to 7.5%, optimally 7%) of the weight of viscose, as a blowing agent, from 3% to 5% (preferably 3.5 to 4.5%, optimally 4%) of alkali-metal carbonate, such as sodium or potassium carbonate or sodium or potassium bicarbonate based on weight of cellulose. Optionally, polyoxyethylene adduct of phenol, such as containing about 5 to 25 moles of ethylene oxide per mole of phenol, preferably 15-dendro phenol which has 15 moles of ethylene oxide per mole of phenol, in the amount of from about 0.25% to 0.75% (preferably 0.2 to 0.5%, optimally 0.3%) on the weight of cellulose is also employed. Said viscose solution having a viscosity of from between about 90 poises and 140 poises (preferably 110 to 130 poises, optimally 120), ripened to a Salt Index from about 6 to 12 milliliters of sodium chloride is desirable, preferably 8 to 10, optimally 9. The viscose solution will desirably contain about 35 to 45% by weight of carbon disulfide, preferably about 36 to 40%, optimally 37%.

The resulting viscose solution is extruded through a spinnerette which comprises capillaries, preferably each having a diameter of from about 30 to 75 microns (preferably 50 microns), into a first coagulating or aqueous acid bath. This bath comprises from about 150 to 220 grams per liter of sodium sulfate as a coagulating agent, preferably about 180 to 210 (optimally 200) grams per liter of sodium sulfate, and from 30 to 80 grams per liter of zinc sulfate, preferably about 40 to 60 (optimally 50) grams per liter of zinc sulfate, and from about 120 to 160 grams per liter of $H_2SO_4$, preferably about 130 to 145 (optimally 135) grams per liter. The coagulating bath shall have a temperature of at least about 25° C. No advantage is obtained by exceeding a temperature of 100° C. A preferred temperature of the bath is about 25° C. to 65° C. or 25° C. to 45° C.

The coagulated fibers from the first coagulating or acid bath are then stretched from about 40 to 180%, preferably 90–100%, either in air or optionally within an aqueous stretch bath. A stretch bath, when employed, comprises from about 5 to 30 grams per liter of $H_2SO_4$, (preferably about 10 to 20 grams per liter) and about 2 to 20 grams, preferably 5 to 15 grams, per liter of zinc sulfate. No advantage is obtained by exceeding about 30 grams per liter of zinc sulfate. The preferred concentration of zinc sulfate is about 9 grams per liter. A stretch bath, when employed, is held at a temperature of from about 80° to 100° C., preferably 95° to 100° C.

In those cases where a subsequent formaldehyde treatment is to be employed, the viscose solution may be extruded into a first coagulating or aqueous acid bath of somewhat broader concentration ranges. Such bath may comprise from about 100 to 400 grams per liter of sodium sulfate, preferably about 180 grams per liter, from 0 to 100 grams per liter of zinc sulfate, preferably about 50 grams per liter, and from about 100 to 200 grams per liter of $H_2SO_4$, preferably about 130 grams per liter. The coagulating bath shall have a temperature of at least about 30° C. No advantage is obtained by exceeding a temperature of 100° C. A preferred temperature of the bath is about 45° C.

When formaldehyde treatment is employed, the coagulated fibers from the first coagulating or acid bath are then optionally passed into an aqueous stretch bath. A stretch bath, when employed, comprises from about 5 to 30 grams per liter of $H_2SO_4$ (preferably about 12 grams per liter) and at least about 2 grams per liter of zinc sulfate. No advantage is obtained by exceeding about 30 grams per liter of zinc sulfate. The preferred concentration of zinc sulfate is about 9 grams per liter. A stretch bath, when employed, is held at a temperature of from about 80° C. to 100° C. The preferred temperature is about 98° C.

Desirably, after coagulating the filaments, they are stetched up to 185% of their original length; preferably to from 40% to 130% of their original length.

In the aldehyde or formaldehyde embodiment of the invention, after the cellulose has been regenerated and the fibers have been stretched, whether in air or in a stretch bath, as described above, they are then passed to an aldehydic treatment bath containing an aldehyde modifying agent. The aldehyde shall comprise at least about 5 grams per liter and no advantage is obtained by exceeding about 60 grams per liter. The preferred range is between about 15 and 45 grams of aldehyde per liter with excellent results being obtained at a concentration of about 40 grams per liter of aldehyde. The preferred aldehyde is formaldehyde and any available form of formaldehyde may be employed, such as aqueous solutions of urea-formaldehyde which provide formaldehyde by release in acid solution. One convenient form of urea-formaldehyde is UF Concentrate 85 of Allied Chemical Corporation containing a ratio of 5 moles of formaldehyde to 1.04 moles of urea. Satisfactory results are obtained with other aldehydes such as acetaldehydes, acrylic, crotonic, and other aliphatic aldehydes, although aromatic aldehydes, such as benzaldehyde, may also be employed. However, formaldehyde and its forms are the most economical and generally the most satisfactory for the process of the invention. The aldehydic bath is necessarily maintained at a pH of less than 7.0. Desirable results are obtained in the range of from about 3 to 7.0 with the preferred pH being about 4.5. The pH may be adjusted by any acid, but sulfuric and hydrochloric acids are preferred. The aldehydic bath is desirably maintained at a temperature of from about 10° C. to 80° C., but preferably about 20° C. The temperature employed will depend somewhat upon the yarn properties desired.

The resulting hollow rayon fibers produced by the processes of the invention can be cut by any conventional method, washed and dried in-line on a steam roll and wound as a continuous hollow fiber or filament.

The fibers produced by the processes of the invention not only have permanent hollowness, but also exhibit high strength and sufficient crimp to permit ease in carding. Table 1, below, is a comparative study of the physical properties of this product as compared to regular rayon, high wet modulus rayon and cotton.

TABLE 1

COMPARISON OF PHYSICAL PROPERTIES OF VARIOUS FIBERS

SINGLE FIBER TEST - INSTRON DATA

| Product | Regular Rayon Staple | High Wet Modulus Rayon | High Strength Hollow Rayon Of The Present Invention | Cotton |
|---|---|---|---|---|
| Conditioned Test* | | | | |
| Tenacity, g/d | 2.1 | 3.2 | 3.2 | 3.3 |
| Elongation, % | 10.7 | 9.5 | 11.0 | 9.0 |
| Initial Modulus, % | 60 | 90 | 80 | 50 |
| Wet Test | | | | |
| Tenacity, g/d | 1.0 | 1.6 | 2.1 | 3.9 |
| Elongation, % | 26 | 18 | 17 | 10.0 |
| Modulus at 5% Ext., g/d | 3.5 | 7.3 | 7.0 | 10.1 |
| Crimps/inch | 8 | 7 | 12 | 20 |

*Conditioned environment - 70° C.-65% relative humidity (yarn exposed for a minimum of 16 hours).

It is apparent from the above Table that the fibers of the present invention have properties similar to commercial high wet modulus rayon and are approaching that of cotton.

Table 2, below, shows data taken on fabrics made from the high strength hollow fibers of the present invention, the rayon fibers and the cotton fibers. All fibers were converted to 28's/1 yarn and woven into an identical fabric construction using both a plain and a 2×2 twill weave.

TABLE 2

FABRIC PROPERTIES

| Fiber Weave | Cotton Plain, 2 × 2 twill | | Hollow Rayon of the Present Invention Plain, 2 × 2 twill | | Bright Rayon Plain, 2 × 2 twill | |
|---|---|---|---|---|---|---|
| Open Area, % | 10.5 | 2.8 | 6.0 | 1.9 | 7.0 | 2.6 |
| Dye Absorption, ppm | 3.1 | 3.5 | 2.8 | 3.3 | 1.9 | 2.6 |
| Air Permeability $ft^3/min/ft^2$ | 103 | 76 | 114 | 74 | 237 | 125 |
| Opacity | 70.7 | 75.7 | 73.8 | 79.5 | 66.2 | 75.6 |

TABLE 2-continued

| | FABRIC PROPERTIES | | | | | |
|---|---|---|---|---|---|---|
| Fiber Weave | Cotton Plain, 2 × 2 twill | | Hollow Rayon of the Present Invention Plain, 2 × 2 twill | | Bright Rayon Plain, 2 × 2 twill | |
| Brightness, % | 75.5 | 77.5 | 65.1 | 67.9 | 70.1 | 69.6 |

It is apparent from these foregoing data that the fabrics made from the hollow rayon fibers of the present invention exhibit bulk coverage and a dye absorption equivalent to that of cotton, and an opacity that is duller than either rayon or bleached cotton. Thus, this fiber also has the covering power and dye uptake equivalent to cotton.

SPECIFIC DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

EXAMPLE 1

The process conditions used in the experiments of this example and in producing the hollow fibers tested in Table 1, above, were as follows:

The pulp was kraft hardwood, rayon cellulose equal to 99%, having a degree of polymerization of about 520. A steeping of the pulp took place in a steeping solution having a sodium hydroxide concentration of 18%, containing the cellulose in a concentration of 34.5% of alkali cellulose, and a temperature of 22° C. The viscose obtained from this pulp by the conventional viscose process had a viscosity of 120 poises, with a cellulose content of 7.0% based on weight of viscose, 6% of sodium hydroxide based on weight of viscose, 37–45% carbon disulfide on the weight of cellulose, 4% of sodium carbonate based on the weight of viscose and 0.5% on the weight of cellulose of a polyethylene oxide adduct of phenol containing 15 moles of ethylene oxide for each mole of phenol.

The viscose was then spun through a spinnerette having 720 holes, each of about 50 micron hole size, at a jet velocity of 23.4 meters per minute (yielding an extrusion ratio equal to about 1), into a first coagulating or aqueous acid bath having the following composition:

sulfuric acid, concentration, variable as shown in Table 3 sodium sulfate, concentration, variable as shown in Table 3 zinc sulfate, 50 g/l

The filaments were immersed for a distance of 45 inches in this bath. The filaments or fibers resulting from the first coagulating bath were then first passed through a second or stretch bath containing 12 grams per liter of sulfuric acid and 9 grams per liter of zinc sulfate at a temperature of 98° C. The fibers were then washed on a wash roll and dried on a steamheated roll (surface temperature 60° C.–80° C.) and wound on a cap twister as a continuous filament at a rate of 25 meters per minute.

Table 3, below, contains the data for a $3^4$ factorial experiment consisting of a total of 81 experiments. The dependent variable is the number of open fibers expressed as a percentage of the total fibers produced. The variables studied in this experiment are:

| Parameter | Level |
|---|---|
| Spin bath temperature, ° C. | 25, 45, 65 |
| $H_2SO_4$ in spin bath, g/l | 84, 107, 130 |
| $Na_2SO_4$ in spin bath, g/l | 160, 200, 240 |
| Salt Index, NaCl | 8, 10, 12 |
| (Equivalent $CS_2$, % on cellulose) | (37, 40, 45) |

TABLE 3

| FACTORIAL STUDY | | | | |
|---|---|---|---|---|
| Acid Temp. | $H_2SO_4$, g/l | Sodium Sulfate, g/l | Salt Index | % Open |
| | | | 8 | 20 |
| | | 160 (23.7) | 10 | 50 |
| | | | 12 | 1 |
| | 84 (18.6) | 200 (8.3) | 10 | 10 |
| | | | 12 | 5 |
| | | | 8 | 1 |
| | | 240 (23.7) | 10 | 50 |
| | | | 12 | 20 |
| | | | 8 | 5 |
| | | 160 (4) | 10 | 2 |
| | | | 12 | 5 |
| 25 (46.6) | 107 (55.2) | 200 (65) | 10 | 90 |
| | | | 12 | 80 |
| | | | 8 | 97 |
| | | 240 (96.7) | 10 | 95 |
| | | | 12 | 98 |
| | | | 8 | 1 |
| | | 160 (1.3) | 10 | 2 |
| | | | 12 | 1 |
| | | | 8 | 95 |
| | 130 (65.9) | 200 (97.7) | 10 | 98 |
| | | | 12 | 100 |
| | | | 8 | 97 |
| | | 240 (98.7) | 10 | 100 |
| | | | 12 | 99 |
| | | | 8 | 15 |
| | | 160 (13.3) | 10 | 15 |
| | | | 12 | 10 |
| | | | 8 | 15 |
| | 84 (22.3) | 200 (7.0) | 10 | 5 |
| | | | 12 | 1 |
| | | | 8 | 60 |
| | | 240 (46.7) | 10 | 20 |
| | | | 12 | 60 |
| | | | 8 | 90 |
| | | 160 (65) | 10 | 95 |
| | | | 12 | 10 |
| | | | 8 | 90 |
| 45 (56.3) | 107 (66.9) | 200 (85) | 10 | 75 |
| | | | 12 | 90 |
| | | | 8 | 2 |
| | | 240 (50.7) | 10 | 75 |
| | | | 12 | 75 |
| | | | 8 | 90 |
| | | 160 (70) | 10 | 90 |
| | | | 12 | 30 |
| | | | 8 | 80 |
| | 130 (79.7) | 200 (87.7) | 10 | 85 |
| | | | 12 | 98 |
| | | | 8 | 50 |
| | | 240 (81.3) | 10 | 95 |
| | | | 12 | 99 |
| | | | 8 | 5 |
| | | 160 (6.7) | 10 | 5 |
| | | | 12 | 10 |
| | | | 8 | 20 |
| | 84 (13.5) | 200 (17) | 10 | 30 |
| | | | 12 | 1 |
| | | | 8 | 10 |
| | | 240 (16.7) | 10 | 30 |
| | | | 12 | 10 |
| 65 (36.1) | | | 12 | 10 |
| | | | 8 | 20 |
| | | 160 (70) | 10 | 95 |
| | | | 12 | 95 |
| | | | 8 | 5 |
| | 107 (36.3) | 200 (35) | 10 | 50 |
| | | | 12 | 50 |
| | | | 8 | 2 |
| | | 240 (4) | 10 | 5 |
| | | | 12 | 5 |
| | | | 8 | 20 |
| | | 160 (36.7) | 10 | 10 |

TABLE 3-continued

| FACTORIAL STUDY | | | | |
|---|---|---|---|---|
| Acid Temp. | $H_2SO_4$, g/l | Sodium Sulfate, g/l | Salt Index | % Open |
| | | | 12 | 80 |
| | | | 8 | 70 |
| | 130 (58.6) | 200 (78.3) | 10 | 80 |
| | | | 12 | 85 |
| | | | 8 | 90 |
| | | 240 (60.7) | 10 | 2 |
| | | | 12 | 90 |

() Signifies the average value for the grouping.

EXAMPLE 2

A series of experiments was conducted employing as a modifier ethylene oxide adducts of phenol, in which the number of moles of ethylene oxide was varied from 5–25 for each mole of phenol. The amount of modifier added to the viscose used in these trials was 0.5% on the weight of cellulose. For comparative purposes, this study also contained trials where no modifier was used in the system. The fibers produced from each run were subjected to 5 wash and dry cycles. At each laundering cycle, cross-sections of the fibers were examined under the microscope and assessed for percentage of fibers which were hollow.

Table 4, below, shows the results of this study. The data indicated in Table 4 set forth the process conditions as well as the results. They show that that a modifier is not necessary in the process and that the hollowness is maintained by the specific process conditions as illustrated in Example 1, above, excluding the modifier.

TABLE 4

Effect Of Moles Of Ethylene Oxide In Polyethylene Oxide Adduct Of Phenol In Fiber Hollowness

| Modifier Employed | % of Fibers Remaining Hollow After No. of Wash Cycles | | | | | |
|---|---|---|---|---|---|---|
| 0.5% on Cellulose | 0 | 1 | 2 | 3 | 4 | 5 |
| No Modifier Used | 90 | 85 | 85 | 75 | 80 | 90 |
| 5 E. O. per Phenol* | 95 | 90 | 90 | 90 | 90 | 95 |
| 15 E. O. per Phenol* | 95 | 95 | 90 | 85 | 50 | 95 |
| 25 E. O. per Phenol* | 95 | 95 | 85 | 50 | 95 | 95 |
| No Modifier Used | 95 | 90 | 90 | 95 | 95 | 90 |
| 5 E. O. per Phenol* | 95 | 90 | 90 | 90 | 70 | 80 |
| 15 E. O. per Phenol* | 95 | 95 | 80 | 100 | 95 | 90 |
| 25 E. O. per Phenol* | 95 | 95 | 90 | 95 | 95 | 90 |

*Expressed as number of moles of ethylene oxide ("E.O.") per mole of phenol.

Process Conditions

| Viscose Composition | |
|---|---|
| Cellulose, 7% | Salt Index - 8.5 |
| NaOH, 7% | Viscose Viscosity - 120 poise |
| $CS_2$, on Cellulose, 37% | |
| $Na_2CO_3$ - 4% | |
| Acid Spin Bath Composition | Acid Stretch Bath Composition |
| $H_2SO_4$, g/l - 130 | $H_2SO_4$, g/l - 12 |
| $ZnSO_4$, g/l - 50 | $ZnSO_4$, g/l - 9 |
| $Na_2SO_4$, g/l - 160 | Temp., °C. - 95 |
| Temp. °C. - 45 | Stretch, - 100% |

Spin Speed - 25 meter/min.
All other conditions the same as Example 1, above.

The following examples illustrate that embodiment of the process employing a formaldehyde treatment to provide the high degree of hollow retention in hollow rayon fibers.

EXAMPLE 3

In order to determine the role that zinc and formaldehyde play on the degree of hollowness of the fibers, the following study was conducted in which the variables zinc and formaldehyde were studied over a broad spectrum. Table 5 (below) illustrates the levels of each of these parameters studied as well as the resulting properties experienced.

TABLE 5

| $ZnSO_4$ g/l | Total Urea HCHO g/l | $Na_2CO_3$, % | Cone Density | Moisture | Dielectric* | Conditioned | Wet | | | |
|---|---|---|---|---|---|---|---|---|---|---|
| Acid Bath | in Baths | in Viscose | g/cc | Regain, % | p.f. | Denier | ten., g/d | Elg., % | ten., g/d | Elg., % |
| 17 | 0 | 0 | 0.834 | 13.3 | 180 | 1082 | 2.26 | 9.6 | 1.01 | 21.7 |
| 17 | 0 | 4 | 0.604 | 14.6 | 250 | 1104 | 1.92 | 9.7 | 0.98 | 25.8 |
| 17 | 20 | 4 | 0.593 | 15.8 | 500 | 1121 | 1.91 | 10.5 | 0.93 | 24.9 |
| 35 | 0 | 4 | 0.510 | 14.6 | — | 1143 | 1.87 | 11.2 | 0.88 | 24.6 |
| 35 | 20 | 4 | 0.488 | 15.0 | 485 | 1143 | 1.84 | 10.3 | 0.90 | 25.7 |
| 35 | 25 | 4 | 0.545 | 15.9 | — | 1082 | 1.87 | 10.7 | 0.99 | 24.6 |
| 0 | 0 | 0 | 0.847 | 12.9 | 150 | 988 | 1.99 | 5.9 | 0.92 | 18.0 |
| 0 | 5 | 0 | 0.738 | 13.6 | — | 977 | 2.17 | 6.4 | 0.94 | 18.8 |
| 0 | 25 | 0 | 0.706 | 13.5 | 355 | 1027 | 2.32 | 9.9 | 1.03 | 21.4 |
| 0 | 5 | 0 | 0.766 | 12.6 | — | 1060 | 2.19 | 8.2 | 1.04 | 18.7 |
| 0 | 5 | 4 | 0.653 | 14.1 | 430 | 1060 | 1.99 | 5.8 | 1.02 | 17.7 |
| 0 | 25 | 4 | 0.570 | 15.4 | 440 | 1043 | 2.00 | 6.0 | 1.02 | 19.9 |
| 17 | 25 | 4 | 0.479 | 15.5 | 510 | 1042 | 1.90 | 7.0 | 0.92 | 21.0 |

*NOTE:
Yarns made with high zinc in the spin bath had excessive zinc on yarn, causing high conductivity and resulting in lower than expected dielectric capacity. The two high zinc samples were therefore deleted from the analysis.

The property defined as cone density in Table 5 is a method which was developed to assess the degree of hollowness of the fiber. It measures the winding density of a cone of yarn after the yarn is wound at a fixed surface velocity, denier, tension, and time.

The property defined as dielectric capacity in Table 5 is a measurement of the ability of a fiber to store an electrical charge in picofarads, Pf. This is directly proportional to the volumetric displacement of a fixed weight of fibers. A regression of dielectric capacity on cone density yielded a correlation coefficient of $r^2 = 0.91$ or 91% of the variation in the yarn dielectric data is explained by the cone density data according to the following model:

Yarn Dielectric Capacity, $pf = 2{,}963d - 2841.5d^2 - 284$ where d = Cone Density This shows that the yarn dielectric capacity is a function of the hollowness of the fiber.

The processing conditions used in the experiments of this Example and Table 5 were as follows:

The pulp was kraft hardwood, rayon cellulose equal to 99%, having a degree of polymerization of about 520. A steeping of the pulp took place in a steeping solution having a sodium hydroxide concentration of 18%, containing the cellulose in a concentration of 34.5% of alkali cellulose, and a temperature of 22° C. The vicose obtained from this pulp by the conventional viscose process had a viscosity of 46.5 poises, a ripening index (NaCl) of 4, 34% carbon disulfide based on weight of cellulose, with a cellulose content of 7.0% based on weight of viscose and 6% of sodium hydroxide based on weight of viscose.

The viscose was then spun through a spinnerette having 720 holes, each of about 50 micron hole size, into a first coagulating or aqueous acid bath having the following composition:

130 grams per liter of sulfuric acid
272 grams per liter of sodium sulfate
0–50 grams per liter of zinc sulfate The filaments or fibers resulting from the first coagulating bath (temperature 45° C.) were first passed through a second or stretch bath containing 12 grams per liter of sulfuric acid and 9 grams per liter of zinc sulfate at a temperature of 98° C. The filaments were then passed from this stretch bath to a third bath which optionally contained urea-formaldehyde, as indicated in Table 5, in the amount indicated, with the bath at a pH of 4.5, having been adjusted with sulfuric acid. The bath had a temperature of 20° C. The urea-formaldehyde employed was UF Concentrate 85 of Allied Chemical Corporation containing a ratio of 5 moles of formaldehyde to 1.04 moles of urea with the amount of urea-formaldehyde indicated, if present, in Table 5, based on total weight of urea-formaldehyde. The fibers were then washed on a wash roll and dried on a steamheated roll (surface temperature 60° C.–80° C.) and wound on a cap twister as a continuous filament.

Table 5 discloses the amount of sodium carbonate present, if at all, in the viscose in each of the runs as well as the amount of zinc sulfate, if at all, in the first coagulating (acid bath) bath. The Table also discloses the amount of urea-formaldehyde employed, if at all, in the third bath.

The data on Table 5 were subjected to a multiple regression analysis that compared each variable with each response. The responses that yielded a high correlation were: moisture regain, cone density and dielectric capacity.

The moisture regain of these fibers showed a strong correlation with sodium carbonate, urea-formaldehyde and zinc sulfate in the system. The model of best fit developed by least squares explained approximately 92% of the variation in the data and is:

$$\text{Moisture Regain} = 13.035 + 0.107X_1 + 0.295X_3 + 0.000806X_2^2 + 0.00691X_2X_3$$

Where
$X_1$ = Zinc Sulfate in spin bath
$X_2$ = Total urea-formaldehyde in system, g/l
$X_3$ = Sodium carbonate as a percentage of the viscose used At the 4% sodium carbonate level, the model suggests that when the urea-formaldehyde in the system is increased from 0 to 25 g/l, the moisture regain of the fibers is expected to rise from 14.2% to 15.4%, or an 8.2% increase. When the zinc sulfate is increased in the spin bath from 0 to 25 g/l, the moisture regain will increase from 14.2% to 15.7%. It is apparent that the treatment with urea-formaldehyde has had a significant effect on the moisture absorption capacity of rayon suggesting that these fibers contain a greater number of voids and fewer hydrogen bonded sites.

The dielectric capacity of these fibers showed a strong correlation with sodium carbonate and urea-formaldehyde used in the system. The model of best fit explains 91% of the data and is:

$$\text{Yarn Dielectric} = 205.17 + 34.81X_2 + 1.0225X_2X_3 - 1.1525X_2^2$$

Where
$X_2$ = Urea-formaldehyde in system, g/l
$X_3$ = Sodium carbonate, as a percentage of the viscose The model suggests that when urea-formaldehyde is increased from 0 to 17 g/l at a 4% sodium carbonate level, the yarn dielectric will be increased from 205 to 533 pf. The effect of zinc in this test is biased by the electrical conductivity properties of zinc itself.

The cone winding density showed a strong correlation between zinc, urea-formaldehyde and sodium carbonate. The model of best fit explained 91% of the data and is:

$$\text{Cone Density, g./cc.} = 0.799 - 0.00297X_2 - 0.0365X_3 - 0.000684X_1X_3$$

where
$X_1$ = Zinc sulfate in spin bath, g/l
$X_2$ = Urea-formaldehyde in system, g/l
$X_3$ = Sodium Carbonate, as a percentage of the viscose The addition of the urea-formaldehye, when 4% sodium carbonate is in the viscose, will decrease the cone density from 0.799 g./cc. to 0.579 g./cc. without zinc sulfate in the bath. When 25 g/l of zinc sulfate is added into the spin bath, the cone winding density is further reduced to 0.483 g./cc. or an increase in bulk of 165%. This study directly shows that the use of aldehyde in the system increased the bulk properties and thereby prevents hydrogen bonding when the fiber has been dried.

The resulting hollow rayon fibers or filaments can be dried by conventional means.

EXAMPLE 4

Hollow fibers were spun using the conditions as set forth in Example 3, except that the spin bath contained 17 g/l zinc sulfate. Samples were made both with and without 20 g/l urea-formaldehyde in the third bath. All samples were subjected to five standard wash and dry cycles. These samples were then sectioned and the freeze-dried sections were examined under the microscope for degree of hollowness. The sample that was treated with urea-formaldehyde in the third bath possessed a more open structure, 75% open, while the sample made without urea-formaldehyde was only 40% open.

EXAMPLE 5

This example is directed to a study on the effects of an additive or modifier in the viscose. In this study it was found that the modifier employed produced a hollow fiber of continuous lumen having greater resistance to wall collapse than the fibers produced by Examples 3 and 4. The fibers also have greater strength than conventional non-hollow rayon fibers. Also, the walls of the hollow fibers are stiffer than those of the fibers of Examples 3 and 4. The conditions in the spin bath were altered somewhat so as to permit greater activity with the blowing agent. The resulting fibers contained continuous lumens that remained open even after many repeated washing and drying cycles. They also possessed high conditioned and wet strength. It was found that the best results were obtained when from 0.5% to 1.0% on the weight of cellulose of 15-dendro phenol was used as a modifier in the viscose, and the spin bath contained at least 130 g/l $H_2SO_4$, 160 g/l sodium sulfate, 50 g/l zinc sulfate, and was at a temperature of at least 35° C.

In order to optimize the process, a study was conducted of the three parameters: 15-dendro phenol, immersion distance in the spin bath, and urea-formaldehyde addition in the third bath. Table 6, below, illustrates the levels of each parameter studied as well as the resulting properties experienced. Process conditions in this example were the same as Example 3, except as follows:

| | |
|---|---|
| Viscose Viscosity, Poises | 124 |
| Ripening Index (NaCl) | 8–10 |
| Carbon Disulfide, % of Cellulose | 37 |
| Viscose, Sodium Hydroxide, % | 6 |
| Sodium Carbonate in Viscose, % | 4 |
| Spin Bath Composition: | |
| $H_2SO_4$, g/l | 130 |
| $Na_2SO_4$, g/l | 160 |
| $ZnSO_4$, g/l | 50 |
| Stretch, % | 95–100 |

The data in Table 6, below, were subjected to a multiple regression analysis that compared each variable with the response percentage of hollow fibers. The model of best fit developed by least squares explained approximately 83% of the variation in the data and is:

$$\text{Percentage of Hollow Fibers} = 64.4 + 183.2\,X_1 + 5.1\,X_3 - 248\,X_1^2 + 71.8\,X_1^3$$

Where:

$X_1$ = 15-dendro phenol as a percentage of the cellulose.

$X_3$ = Concentration of urea-formaldehyde in the third bath, %.

At a 4% sodium carbonate level, and when 15-dendro phenol is not used in the process, the model suggests that when the urea-formaldehyde in the third bath is increased from 0 to 4% the percentage of hollow fibers produced will increase from 64% to 84%. When 1% 15-dendro phenol is used, the percentage of open fibers when urea-formaldehyde is not used is only 71.3%, but when urea-formaldehyde is used with the 15-dendro phenol, the percentage of open fibers is 91.3%. The resulting hollow fibers or filaments can be dried by any conventional means and can be subjected to repeated washing and drying cycles without experiencing fiber wall collapse.

TABLE 6

Effect of 15 Dendro Phenol, Urea Formaldehyde, And Immersion On The Percentage Of Hollow Fibers And Physical Poperties

| 15 Dendro Phenol % On Cellulose | Spin Bath Immersion Inches | Urea Formaldehyde % In Third Bath | Hollow Fibers % | Denier g/9000 m | Conditioned Tenacity, g/d | Conditioned Elongation, % | Wet Tenacity, g/d | Wet Elongation, % | Wet Modulus At 5% Extension g/d |
|---|---|---|---|---|---|---|---|---|---|
| 0 | 21 | 0 | 90 | 977 | 3.88 | 7.3 | 2.36 | 12.7 | 10.5 |
| 0 | 21 | 4 | 95 | 1005 | 3.64 | 6.8 | 2.22 | 12.7 | 10.0 |
| 0 | 34 | 4 | 98 | 1005 | 3.65 | 6.5 | 2.33 | 12.5 | 11.5 |
| 0 | 34 | 0 | 60 | 1016 | 3.62 | 6.0 | 2.22 | 12.4 | 10.4 |
| 1 | 34 | 0 | 85 | 1071 | 3.40 | 7.4 | 2.20 | 12.0 | 11.2 |
| 1 | 34 | 4 | 100 | 1066 | 3.46 | 6.7 | 2.21 | 11.9 | 10.7 |
| 1 | 21 | 4 | 95 | 1066 | 3.61 | 7.1 | 2.34 | 12.4 | 13.2 |
| 1 | 21 | 0 | 90 | 1066 | 3.63 | 7.0 | 2.27 | 12.0 | 12.1 |
| 1.5 | 21 | 0 | 50 | 1016 | 2.80 | 6.0 | 1.73 | 11.3 | 9.7 |
| 1.5 | 21 | 4 | 50 | 1021 | 2.84 | 6.3 | 1.67 | 12.1 | 7.0 |
| 1.5 | 34 | 4 | 80 | 1016 | 2.86 | 6.1 | 1.63 | 10.8 | 11.6 |
| 1.5 | 34 | 0 | 40 | 1021 | 2.83 | 6.1 | 1.60 | 10.9 | 10.5 |
| 2.0 | 34 | 0 | 25 | 1049 | 2.75 | 6.8 | 1.61 | 11.8 | 8.0 |
| 2.0 | 34 | 4 | 50 | 1043 | 2.84 | 6.9 | 1.67 | 12.1 | 7.0 |
| 2.0 | 21 | 4 | 50 | 1032 | 2.86 | 6.8 | 1.75 | 12.3 | 9.5 |
| 2.0 | 21 | 0 | 10 | 1038 | 2.92 | 6.3 | 1.80 | 12.5 | 9.3 |
| 1.5 | 21 | 0 | 20 | 1021 | 3.14 | 7.8 | 1.86 | 13.5 | 8.0 |
| 1.5 | 21 | 4 | 25 | 1038 | 3.27 | 8.1 | 1.86 | 13.7 | 7.5 |
| 1.5 | 34 | 4 | 60 | 1027 | 3.05 | 7.1 | 1.87 | 12.5 | 9.6 |
| 1.5 | 34 | 0 | 30 | 1038 | 2.89 | 7.2 | 1.85 | 13.9 | 10.4 |

As will be apparent to those skilled in the art from the present description, in place of the urea-formaldehyde employed in the foregoing examples, other forms of formaldehyde, such as paraldehyde and formaldehyde solutions per se and other akdehydes, such as acetaldehyde, crotonic aldehyde, and other aliphatic and aromatic aldehydes, including benzaldehyde, may be employed with satisfactory results.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A process for producing hollow rayon fibers resistant to collapse after drying, which process comprises spinning a viscose solution containing alkali cellulose, a blowing agent selected from the class consisting of alkali-metal carbonates and bicarbonates, carbon disulfide, and ripened to a Salt Index of from about 6 to 12 cubic centimeters of sodium chloride, into an aqueous acidic coagulating bath containing from about 150 to 220 grams per liter of sodium sulfate, from about 120 to 160 grams per liter of sulfuric acid, and from about 30 to 80 grams per liter of zinc sulfate, and thereafter stretching the resulting hollow rayon fibers by between about 40 and 120%.

2. A process in accordance with claim 1, wherein said viscose solution contains cellulose in an amount of from about 6 to 9% by weight on weight of viscose, alkali-metal hydroxide in an amount of from about 6 to 8% on weight of viscose and a viscosity of from about 90 to 140 poises.

3. A process in accordance with claim 1, wherein said viscose solution contains cellulose in an amount of from about 6.5 to 7.5% by weight on weight of viscose, sodium hydroxide in an amount of from about 6.5 to 7.5% on weight of viscose, carbon disulfide in an amount of between about 35 and 45% by weight of cellulose, and a viscosity of from about 110 to 130 poises.

4. A process in accordance with claim 1, wherein the aqueous acidic coagulating bath is maintained at a temperature of from about 25° to 65° C.

5. A process in accordance with claim 1, wherein the aqueous acidic coagulating bath is maintained at a temperature of between about 25° and 45° C.

6. A process in accordance with claim 1, wherein the blown filaments, after being formed in the aqueous acid coagulating bath, are passed into an aqueous bath comprising between about 5 and 30 grams per liter of sulfuric acid, between about 2 and 20 grams per liter of zinc sulfate and maintained at a temperature of from about 80° to 100° C., and stretching said filaments between about 40 and 120%.

7. A process according to claim 6, wherein the filament is stretched to between about 90 and 110%.

8. A process according to claim 1, wherein said viscose also contains between about 0.25% and 2% on weight of cellulose of a polyethylene oxide adduct of phenol containing 15 moles of ethylene oxide for each mole of phenol.

9. A process according to claim 1, wherein said viscose solution also contains between about 0.2% and 0.75% on weight of cellulose of a polyethylene oxide adduct of phenol containing between about 5 and 25 moles of ethylene oxide for each mole of phenol.

10. A process according to claim 9, wherein the amount of said adduct is between about 0.2% and 0.5% on weight of cellulose and contains 15 moles of ethylene oxide for each mole of phenol.

11. A process in accordance with claim 1, wherein the blowing agent is a member selected from sodium carbonate and sodium bicarbonate.

12. A process in accordance with claim 1, wherein the blowing agent is present in an amount of between about 3% and 5%, based on weight of cellulose.

13. A process in accordance with claim 1, wherein said viscose solution contains between about 6 and 9% by weight of cellulose, between about 6 and 8% by weight of alkali-metal hydroxide, between about 35 and 45% by weight of carbon disulfide, between about 3 and 5 by weight of a member selected from an alkali-metal carbonate and bicarbonate as a blowing agent, said viscose solution having a viscosity of between about 90 and 140 poises and said aqueous acidic coagulating bath contains between about 30 and 80 grams per liter of zinc sulfate, between about 150 and 220 grams per liter of sodium sulfate and between about 120 and 160 grams per liter of sulfuric acid, and stretching the resulting hollow rayon fibers by between about 40 and 120%.

14. A process in accordance with claim 1, wherein said viscose solution contains between about 6.5 and 7.5% by weight of cellulose, between about 6.5 and 7.5% by weight of alkali-metal hydroxide, between about 36 and 40% by weight of carbon disulfide, between about 3.5 and 4.5% by weight of a member selected from an alkali-metal carbonate and bicarbonate as a blowing agent, said viscose solution having a viscosity of between about 110 and 130 poises and said aqueous acidic coagulating bath contains between about 40 and 60 grams per liter of zinc sulfate, between about 180 and 210 grams per liter of sodium sulfate and between about 120 and 145 grams per liter of sulfuric acid, and stretching the resulting hollow rayon fibers between about 90 and 110%.

15. A process for producing hollow rayon fibers resistant to collapse after drying, which process comprises spinning a viscose solution containing alkali cellulose, a blowing agent selected from the class of alkali-metal carbonates and bicarbonates, and ripened to a Salt Index of from about 6 to 12 cubic centimeters of sodium chloride, into a first aqueous acidic coagulating bath containing from about 100 to 400 grams per liter of sodium sulfate, and from about 100 to 200 grams per liter of sulfuric acid and after stretching thereafter passing the resulting blown fibers into an aldehydic bath containing between about 5 grams and 60 grams per liter of an aldehyde, said aldehydic bath having a pH of from about 3.0 to 7.0.

16. A process in accordance with claim 16, wherein said viscose solution contains cellulose in an amount of from about 6 to 9% by weight on weight of viscose, alkali-metal hydroxide in an amount of from about 6 to 8% on weight of viscose and a viscosity of from about 90 to 140 poises.

17. A process in accordance with claim 16, wherein the aldehyde is formaldehyde.

18. A process in accordance with claim 16, wherein the aldehyde is urea-formaldehyde.

19. A process in accordance with claim 1, wherein the aldehydic bath is maintained at a temperature of from about 10° to 80° C.

20. A process in accordance with claim 1, wherein the first acid coagulating bath is maintained at a temperature of between about 25° and 65° C.

21. A process according to claim 16, wherein the blown fibers are stretched to between about 40 and 120%.

22. A process according to claim 16, wherein said viscose also contains between about 0.2 and 0.75% on weight of cellulose of a polyethylene oxide adduct of phenol containing between about 5 and 25 moles of ethylene oxide for each mole of phenol.

23. A resilient hollow rayon fiber having the irreversible property of remaining hollow and resisting collapse even after repeated drying and washing cycles, prepared in accordance with the process of claim 1.

24. A resilient hollow rayon fiber having the irreversible property of remaining hollow and resisting collapse even after repeated drying and washing cycles, prepared in accordance with the process of claim 9.

25. A resilient hollow rayon fiber having the irreversible property of remaining hollow and resisting collapse even after repeated drying and washing cycles, prepared in accordance with the process of claim 15.

* * * * *

UNITED STATES PATENT AND TRADEMARK OFFICE

CERTIFICATE OF CORRECTION

PATENT NO. : 4,130,689

DATED : December 19, 1978

INVENTOR(S) : Eugene Costa, Jr.

It is certified that error appears in the above-identified patent and that said Letters Patent are hereby corrected as shown below:

Col. 3, line 57, "regeneation" should be -- regeneration --.

Col. 8, line 18, in Table 3, column headed "Salt Index," below "12" insert -- 8 --, and in column headed "% Open" below "1" insert -- 10 --, respectively.

Col. 8, line 24, in Table 3, column headed "Salt Index," below "12" insert -- 8 --, and in column headed "% Open," below "5" insert -- 25 --, respectively.

Col. 8, line 60, in Table 3, columns headed "Salt Index" and "% Open," delete "12" and "10" (second occurrence) respectively.

Cols. 9-10, line 21, In Table 5, the column heading "Conditioned" should be the heading for columns 8 and 9, and "Wet" should be the heading for columns 10 and 11.

Col. 14, line 33, delete "akdehydes" and replace with -- aldehydes --.

Col. 15, line 44, after "5" insert -- % -- (percent).

UNITED STATES PATENT AND TRADEMARK OFFICE

CERTIFICATE OF CORRECTION

PATENT NO. : 4,130,689

DATED : December 19, 1978

INVENTOR(S) : Eugene Costa, Jr.

It is certified that error appears in the above-identified patent and that said Letters Patent are hereby corrected as shown below:

Col. 16, line 23, in Claim 16, delete "in accordance with claim 16" and replace with -- in accordance with claim 15 --.

Col. 16, line 29, in Claim 17, delete "16" and replace with -- 15 --.

Col. 16, line 31, in Claim 18, delete "16" and replace with -- 15 --.

Col. 16, line 39, in Claim 21, delete "16" and replace with -- 15 --.

Col. 16, line 42, in Claim 22, delete "16" and replace with -- 15 --.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*